US008272186B2

(12) United States Patent
Manning

(10) Patent No.: US 8,272,186 B2
(45) Date of Patent: Sep. 25, 2012

(54) ROOF VENT PIPE SHIELD

(76) Inventor: Mark Stephen Manning, Fuquay-Varina, NC (US)

( * ) Notice: Subject to any disclaimer, the term of this patent is extended or adjusted under 35 U.S.C. 154(b) by 192 days.

(21) Appl. No.: 12/723,896

(22) Filed: Mar. 15, 2010

(65) Prior Publication Data

US 2011/0219723 A1 Sep. 15, 2011

(51) Int. Cl.
*E04F 13/21* (2006.01)

(52) U.S. Cl. ..... 52/741.4; 52/58; 52/198; 52/199; 52/219

(58) Field of Classification Search ..... 52/198–200, 52/302.1, 741.4, 741.3, 94–97, 58, 219, 42, 52/220.8; 454/364–368, 242, 250, 339, 129, 454/358–360, 8–19, 240; 403/361, 375; 285/42–44, 64

See application file for complete search history.

(56) References Cited

U.S. PATENT DOCUMENTS

| | | | | |
|---|---|---|---|---|
| 3,797,181 | A | 3/1974 | Nievelt | |
| 4,864,782 | A | 9/1989 | Hasty | |
| 5,010,700 | A * | 4/1991 | Blair | 52/199 |
| 5,226,263 | A * | 7/1993 | Merrin et al. | 52/58 |
| 5,245,804 | A | 9/1993 | Schiedegger et al. | |
| 5,347,776 | A * | 9/1994 | Skoff | 52/219 |
| 5,502,935 | A * | 4/1996 | Demmer | 52/200 |
| 5,588,267 | A | 12/1996 | Rodriguez et al. | |
| 5,694,724 | A | 12/1997 | Santiago | |
| 6,185,885 | B1 * | 2/2001 | Thaler | 52/219 |
| 6,244,006 | B1 | 6/2001 | Shue et al. | |
| 6,279,272 | B1 * | 8/2001 | Nill, Jr. | 52/58 |
| 6,966,156 | B2 * | 11/2005 | Dixon | 52/199 |
| 7,818,928 | B2 * | 10/2010 | Brunt et al. | 52/218 |
| 2008/0040987 | A1 * | 2/2008 | Dreisacker | 52/101 |
| 2008/0098673 | A1 * | 5/2008 | Johnston et al. | 52/198 |

OTHER PUBLICATIONS

Creative Composites & Plastic Solutions, Welcome to Creative Composites & Plastic Solutions, http://creativecomposite.com, Apr. 21, 2010, US.

* cited by examiner

*Primary Examiner* — Basil Katcheves
*Assistant Examiner* — Beth Stephan
(74) *Attorney, Agent, or Firm* — James G. Passé; Passé Intellectual Property, LLC

(57) ABSTRACT

The present invention relates to a vent pipe protection cover for repairing damaged flashing or for any new construction for waterproofing the vent pipe. A two piece construction which allows one device to accommodate roof pitches and various size vent pipes without the need to custom make the device is disclosed.

7 Claims, 5 Drawing Sheets

ROOF VENT PIPE SHIELD

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

1. Field of the Invention

The present invention relates to plumbing vent stacks that extend above the roof on a building for venting of sewer gases. In particular, the present invention relates to a vent pipe protective cover for protecting the vent pipe when installed over the vent stack.

2. Description of Related Art

A vent stack protrudes from the roof deck of a building with toilet facilities to vent and remove the sewer gases from the sewer trap. The vent stack is normally installed at the time the building is built, integrated into the roof as it is installed and sealed with a flashing that creates a gasket seal against the vent pipe. The installed vent stack system is normally weatherproofed at that time. Studies have shown that in as little as 6 or 7 years, the flashing can deteriorate where it contacts the pipe and begin to leak due to the exposure to the elements. In addition, animals such as mammals, birds, reptiles, and the like may damage the flashing integrity while nesting, feeding, or the like.

In states where there is a raised crown surrounding the base used for the flashing around the vent stack pipe, it is quite common that the flashing leaks begin at the intersection where the vent pipe enters the crown.

When the flashing begins to leak, the building owner is faced with either replacing the entire vent which is an expensive and probably prohibitive procedure, or use one of a number of covers. A number of covers have been available for covering the leaking roof vent stack, however, the current ones all suffer from problems such as the need to have multiple sizes, ones to accommodate different roof pitches and attachment means which are readily susceptible to leaking. Because vent stacks are not cut to exact standard sizes, they vary in height by a large amount and covers of a specific height are difficult to install, if not impossible in some cases to use. In the case where there is a raised crown surrounding the base, many of the solutions will not work at all since they are designed to be used with a flat base, and will not work with a raised base.

U.S. Pat. No. 3,797,181 issued Mar. 19, 1974 to Nievelt, teaches a cylindrical cover of a fixed size, which requires a different height device for each vent pipe. In U.S. Pat. No. 5,245,804 issued Sep. 21, 1993 to Schieddegger et al., a roof vent pipe shield comprises an outer plastic cylinder and an inner plastic cylinder connected at one end by a fusion creating space between the cylinders. Once again, the device requires that it be custom made to a height that matches each vent pipe.

U.S. Pat. No. 5,694,724 issued Dec. 9, 1997 to Santiago discloses a stack vent cover used for flashing. This cover acts as flashing and requires attachment to the roof. In U.S. Pat. No. 6,244,006 issued Jun. 12, 2001 to Shue et al., there is taught a vent pipe cover with a flat flashing porting and an end cap. The end cap does not appear to be secured and is sufficiently small that it can be blown off the device in high winds.

BRIEF SUMMARY OF THE INVENTION

The Invention relates to the discovery that a two piece weatherproof cover overcomes many of the problems associated with the previous methods of weatherproofing a vent stack pipe, either in new construction or after a flashing failure. In particular, by having a piece that covers a portion of the vent pipe and rests on the boot of the vent stack pipe and then a second portion which fits inside and outside the vent stack pipe and covers the top of the first portion, a weather tight fitting can be accomplished along with a single device being adapted for various sizes of vent stack pipes for either new construction flashing or repairing flashing leaks.

Accordingly, one embodiment of the present invention relates to a plumbing vent pipe cover for use with a raised boot vent flashing on a roof having a selected roof pitch comprising:

a) a first portion comprising:
   i. a cylindrical sheath having an open bottom and top, an inner diameter larger than an outer diameter of the vent pipe, optionally one or more friction rings on the inner diameter for grabbing an outer diameter of the vent pipe and a friction gripping surface on at least a portion of the outer diameter of the sheath for grabbing an inner diameter of a second portion of the cover;
   ii. a flaring boot portion in fluid connection with the open bottom for positioning on the raised boot portion of the vent flashing; and
   iii. an alignment device sufficient to align the sheath on the vent pipe and the flaring boot portion on the raised portion based on the selected roof pitch;

b) a second portion comprising:
   i. an inner and outer cylinder concentrically positioned in spaced relationship by a weatherproof connection at the top end of each cylinder; and
   ii. the spaced relationship for positioning the second portion on the open top of the cylindrical sheath such that the inner cylinder is positioned on the inner part of the sheath and the outer cylinders inner surface is in contact with the friction gripping surface on the outer diameter of the sheath for holding the second portion in place.

Accordingly, in yet another embodiment of the present invention there is a method of weatherproofing a plumbing vent pipe with a raised boot vent flashing on a roof having a selected roof pitch comprising:

a) selecting a cover comprising:
   i. a first portion comprising
      a. a cylindrical sheath having an open bottom and top, an inner diameter larger than an outer diameter of the vent pipe, optionally one or more friction rings on the inner diameter for grabbing an outer diameter of the vent pipe and a friction gripping surface on at least a portion of the outer diameter of the sheath for grabbing an inner diameter of a second portion of the cover;
      b. a flaring boot portion in fluid connection with the open bottom for positioning on the raised boot portion of the vent flashing; and
      c. an alignment device sufficient to align the sheath on the vent pipe and the flaring boot portion on the raised portion based on the selected roof pitch;

ii. a second portion comprising:

a. an inner and outer cylinder concentrically positioned in spaced relationship by a connection at the top end of each cylinder;

b. the spaced relationship for positioning the second portion on the open top of the cylindrical sheath such that the inner cylinder is positioned on the inner part of the sheath and the outer cylinders inner surface is in contact with the friction gripping surface on the outer diameter of the sheath for holding the second portion in place;

b) slidingly engaging the first portion over the vent pipe until the flaring boot portion covers at least a portion of the raised boot portion of the vent flashing; and c) slidingly engaging the second portion over the vent pipe and first portion such that the inner cylinder is positioned inside the vent pipe and the outer cylinder is positioned outside the vent pipe and covers the top of the first portion.

DETAILED DESCRIPTION OF THE INVENTION

Figure 1:
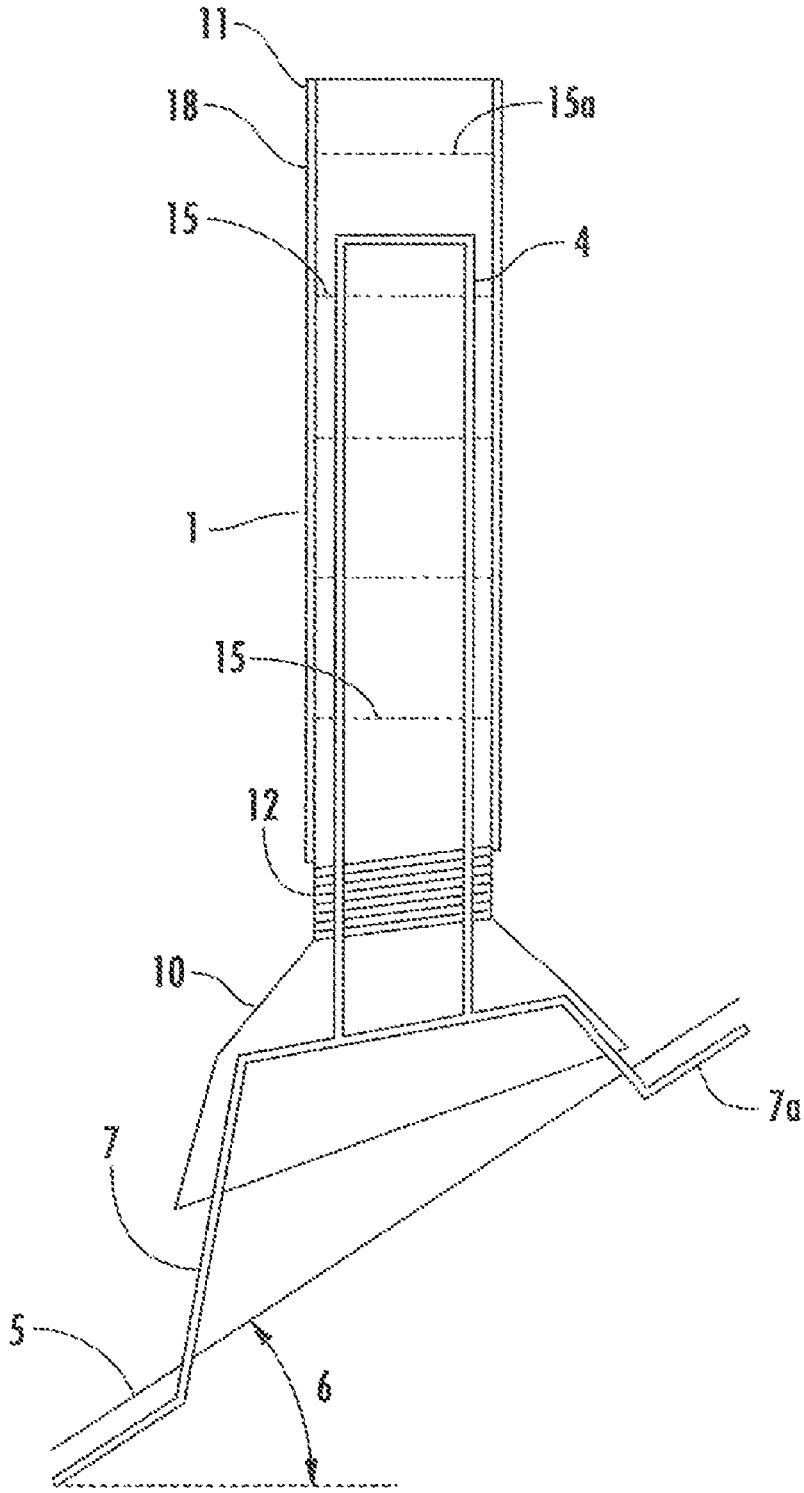
FIG. 1 is a side perspective of the first portion over a vent pipe.

While this invention is susceptible to embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are for the purpose of illustrating certain convenient embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein a "plumbing vent pipe" refers to those vent pipes having a raised boot vent flashing in new or repair construction. A side view of the style of vent pipe flashing can be seen in FIG. 1 as an example. While all boots of such will be raised, there will of course be differences in the style and exact shape based on the individual manufacturer of the flashing. Other examples of such flashing are in U.S. Pat. Nos. 5,588,267 and 4,864,782. As can be seen, the flashing attaches to the roof and then the vent pipe passes through an opening in the flashing creating a gasket seal between the pipe and the flashing. This seal works initially, but frequently leaks, by some reports on average after 7 years, no matter which company's flashing is used. The flashing can be replaced but must include taking up and replacing a small portion of roofing as well.

The present invention comprises a two piece weatherproof covering for placing over the vent pipe and flashing for the purposes of weather proofing. It can repair damaged flashing or used in new construction with flashing that seals or doesn't seal against the vent pipe. This cover can be used after the assembly leaks or at any time prior to leaking occurrences. The first portion of the vent pipe cover comprises a device that covers the lower portion of the exposed vent pipe and covers at least a portion of the raised boot portion of the flashing. A "flaring boot portion" of the first portion covers (circumferentially) the boot where the vent pipe passes through it and comes to rest (circumferentially) on the sides of the raised boot, thus, covering the top of the raised boot completely as well. This can be seen clearly in FIG. 1. In general the first portion is made from a polymeric or rubberized weatherproof material. Such materials for manufacturing roof devices are well known. In one embodiment, such materials are a polypropylene/rubber blend but essentially any weatherproof material could be selected.

Attached to the flaring boot portion is a "cylindrical sheath" having an open bottom and top. The bottom is in fluid communication with the flaring boot portion such that the first portion can be placed over the vent pipe and at least a portion of the raised boot. The inner diameter of the cylindrical sheath is larger than the vent pipe. The inner diameter of the cylindrical sheath is optionally lined with one or more friction rings which hold onto the vent pipe by friction against the vent pipe. The friction rings can be polymeric, rubberized, or the like, or any kind of inner ring which creates friction against the vent pipe for holding the first portion in place. Other means include high friction surfaces and the like. The exact material and the manufacture of a friction ring is based on the material of the vent pipe the diameter and the like, and is within the skill in the art in view of this disclosure. While gravity will initially hold the first portion in place by the use of friction rings or friction, one can be assured the device will remain in place during high winds and storms. Also, if the flaring boot portion is tight against the raised boot, then there is less chance for wind or rain to blow underneath the device's first portion.

The outer diameter of the cylindrical sheath has on at least a portion of the surface a friction gripping surface. The friction surface can be a roughed surface, a coating, or the like that increases friction between the outer diameter and the second portion placed on the first portion as described below. The friction portion can cover the entire cylindrical sheath but only needs to be where it will come in contact with the first portion. One skilled in the art can decide where and how much friction surface is necessary to place the first portion over the second portion and hold it in place during normal weather conditions. The rough surface can be made by abrasion, attaching a rough material to the surface of the sheath and selecting a material with sufficient friction coefficient. The rough surface can also be molded into the sheath or by any manner that leaves a portion of the surface rough. The exact material selected is within the skill in the art in view of the present teaching.

The lower portion of the cylindrical sheath has an alignment which is sufficient to angle and align the sheath on the vent pipe and at the same time align the flaring boot portion on the raised boot of the flashing. Because the roof will have a selected pitch to it, the flaring boot portion will need to be at an angle to properly cover the raised boot of the flashing. The alignment device allows for the flashing to be angled as desired and held in place by friction and gravity. For example, a series of 1 or more accordion pleats could be in the lower portion of the cylindrical sheath. Another alignment device would be use of a flaring boot portion which allows the flaring portion to rotate on an acceptor device to the desired angle.

The second portion comprises an inner and an outer cylinder which are concentrically positioned and joined together at their respective top diameters forming a complete seal between the two and forming a spaced relationship between the two cylinders. One way of achieving this is to mold a single piece that is a cylinder turned into itself, though any means of manufacture is contemplated. Since when the first portion is placed on the vent pipe and flashing allowing water to leak between the top diameter of the sheath and the vent pipe, the second portion prevents such leakage and creates the weatherproof seal between the two cover portions. The second portion is held in place by the friction between the inner diameter of the outer cylinder and the high friction surface on a portion of the outer diameter of the sheath.

The two portions are thus held in place with just gravity and friction and as such can be installed in seconds without the need for other attachment means. The height of the cylindrical sheath would normally be higher than the average vent pipe and the inner diameter of the second portion long enough to reach the inner diameter of the vent pipe. Thus, the device could be used on various size vent pipes without the need for any kind of adjustment or use of a tightening ring that exposes the ring connection to the elements. In addition, it can be used to repair or used in new construction.

The device can usually be made by any methods used to manufacture polymeric or rubberized materials, such as injection or blow molding, but could also be fabricated by hand or any other convenient method, such as by sculpting or the like. The function and use of the present cover can be clearly seen from the examples in the drawings which follow.

Now referring to the drawings, FIG. 1 depicts a side view of a first portion 1 of the present cover. Shown is roof 5 having selected pitch angle 6. The raised boot 7 of a vent flashing is shown while a hidden part, 7*a*, is hidden under roof 5. A flaring boot portion 10 is shown covering raised boot 7 while from the side it may not be clear the flared boot 7 is oval shaped and the flaring boot portion 10 is oval to match it.

A cylindrical sheath 11 encircles the vent pipe 4 and friction rings 15 grab the vent 4 except for the highest ring 15*a*. Highest ring 15*a* is positioned for a taller vent pipe than vent pipe 4. An accordion pleat 12 is used as an alignment device positioned in between the sheath 11 and flaring boot portion 10 to allow for angling the flaring boot portion 10 as needed to compensate for roof pitch angle 6. As can be seen in this view the outer diameter 18 of cylindrical sheath 11 has a roughed up surface as will be described below for creating friction and holding the second portion.

Figure 2:
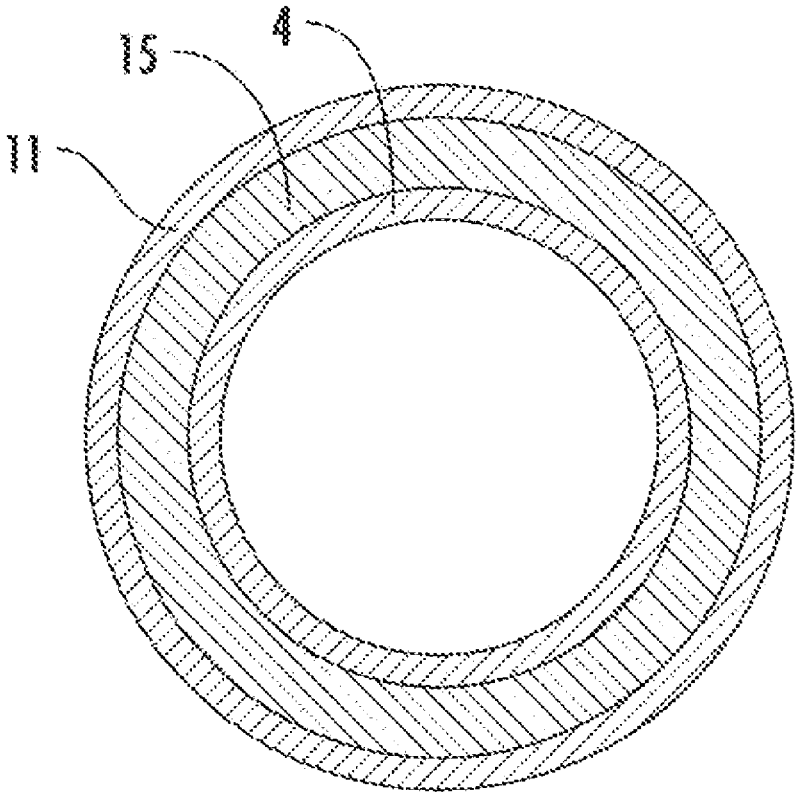
FIG. 2 is a top view of the first portion over a vent pipe showing the friction rings.

FIG. 2 depicts a top view of the cylindrical sheath 11 encircling the vent pipe 4. A top view of an optional friction ring 15 can also be seen.

Figure 3:
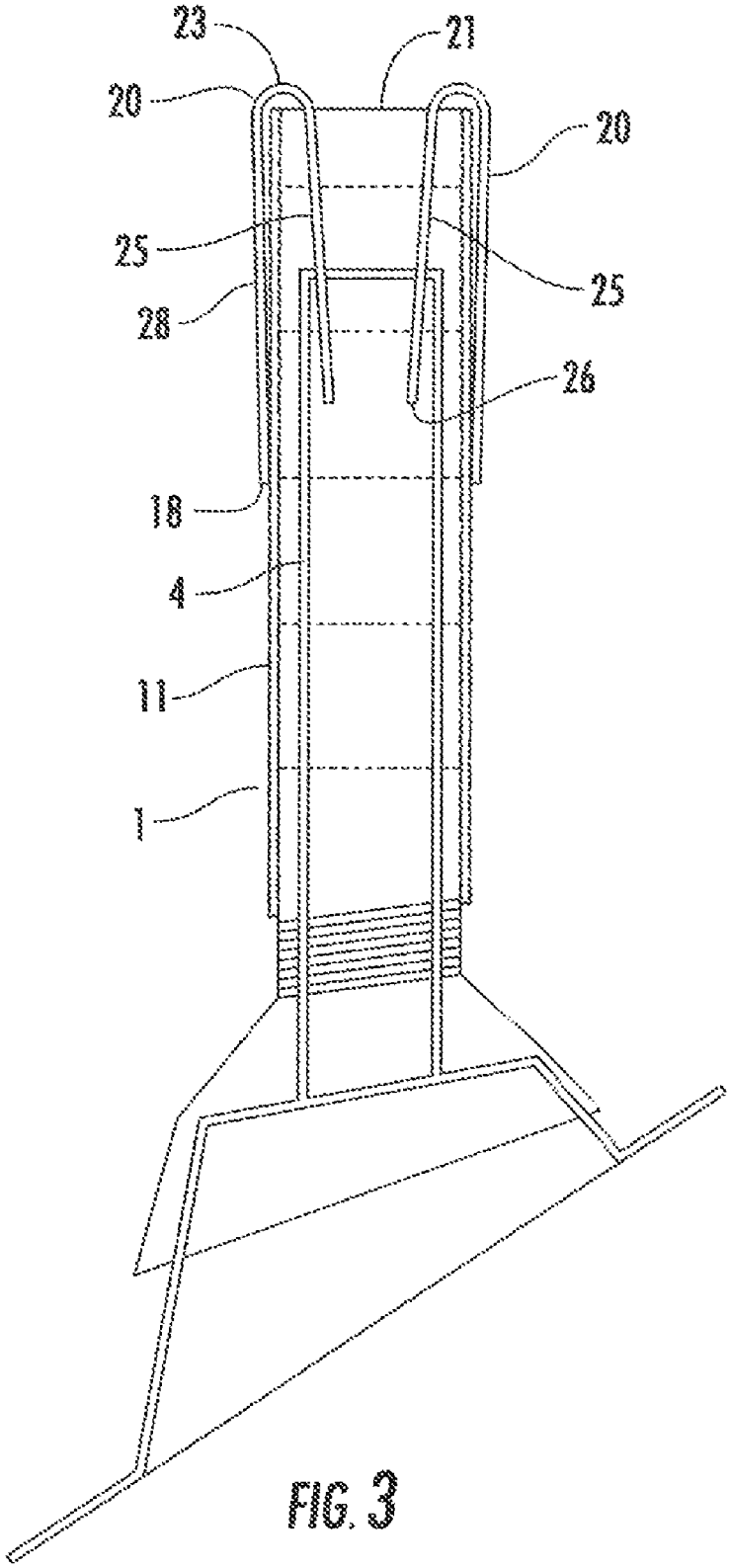
FIG. 3 is a side perspective of the second portion positioned over the first portion on a vent pipe.

FIG. 3 depicts the second portion in cut through view placed on the first portion 1 and the vent pipe 4. The second portion 20 is actually one piece with its top 23 completely encircling the top 21 of the sheath 11. The inner cylinder 25 is positioned with the bottom end 26 inside vent pipe 4. The outer cylinder 28 is positioned on the outer surface 18 of the sheath 11 in a manner that the inner surface of the outer cylinder comes in contact with the outer diameter 18 rough surfaces and holds it in place. In this position rain cannot come between the vent pipe and the first portion 11. And the device is held in place by the friction of the first portion against the raised boot and vent pipe and the second portion held in place by gravity and the friction against the first portion creating a weatherproof seal with minimal work effort.

Figure 4:
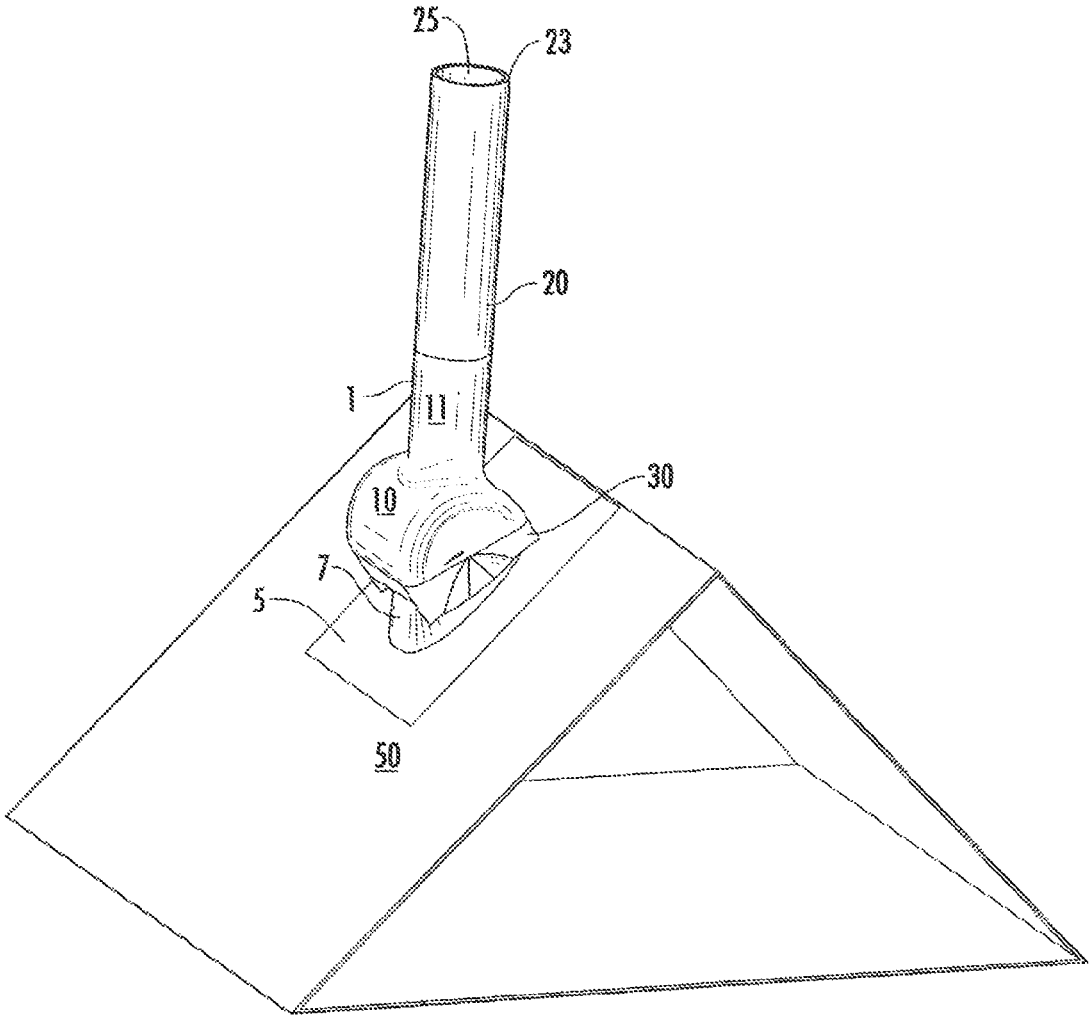
FIG. 4 depicts an embodiment wherein the alignment device is a flaring boot portion acceptor device.

In FIG. 4 depicts an embodiment wherein the alignment device is a flaring boot portion acceptor device. A flaring boot portion 10 is covering raised boot 7. In this embodiment the boot portion 10 also covers acceptor 30. The shape of boot portion 10 matches the acceptor and allows it to rotate to match the roof pitch and still cover an upright vent pipe.

Figure 5:
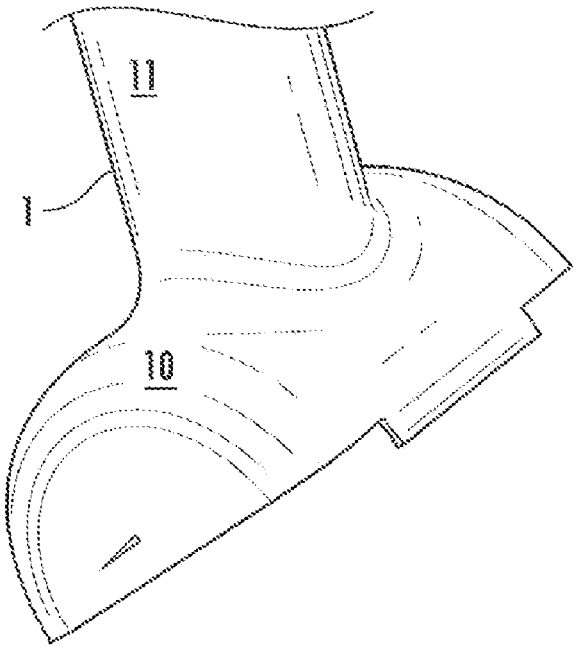
FIG. 5 is an exploded view of the cover of FIG. 4 showing more detail of acceptor 30.
Figure 5:
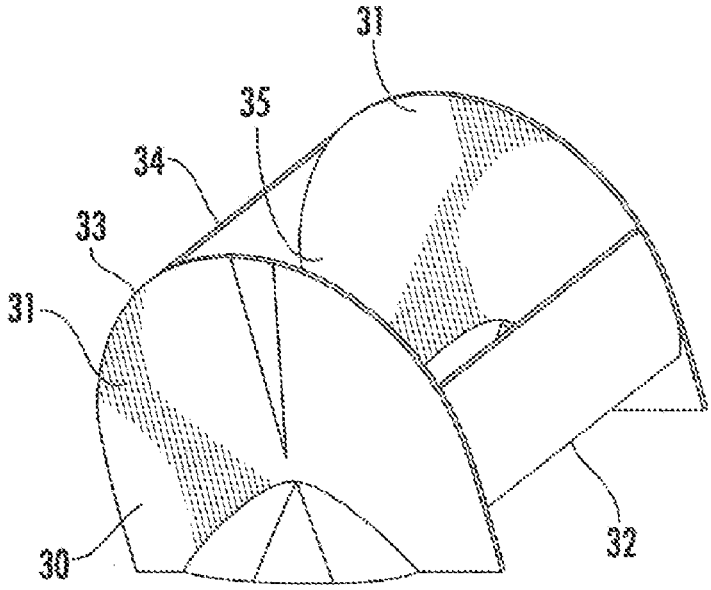

FIG. 5 is an exploded view of the cover of FIG. 4 showing more detail of acceptor 30. The acceptor 30 consists of sides 31, front 32 and back 34. The current top 33 allows the first portion 10 to rotate on the curve 33 to obtain the proper angle to match the roof pitch of a selected roof. The acceptor rests on the raised boot 7 and has pass through 35 to allow a vent pipe to pass through to the first boot portion 10 with enough room to accommodate various roof pitches.

It is clear that the drawings are not intended to be limiting unless otherwise indicated. The claims are to be read in view of the particular description and the drawings intended for the further understanding of the invention and not necessarily as a limiting function thereof.

What is claimed is:

1. A plumbing vent pipe cover for placement on a vent pipe and a vent pipe flashing, the flashing having a raised boot crown and a gasket seal against the vent pipe, wherein the flashing is installed on an inclined roof having a selected roof pitch, the flashing positioned at least partially under roofing material on the roof, the vent pipe cover comprising:

a) a first cover portion comprising:

i. a cylindrical sheath having an open bottom and top for receiving the vent pipe therein, the cylindrical sheath having an inner diameter and an outer diameter, the inner diameter of the sheath being uniform from the top to the bottom, the sheath terminating in a flaring boot portion;

ii. the flaring boot portion in fluid connection with and extending from the open bottom of the sheath for positioning over and covering the raised boot crown of the vent flashing without being positioned beneath the roofing material, the flaring boot portion defining a cavity extending away from the sheath configured to enclose the flashing; and iii. an alignment device adjustably connecting the sheath to the flaring boot portion sufficient to align the sheath on the vent pipe and the flaring boot portion on the raised portion based on the selected roof pitch;

b) a second cover portion comprising:

i. an inner and outer cylinder concentrically positioned in spaced relationship by a weatherproof connection at the top end of each cylinder, wherein a surface of the outer diameter of the sheath is held against an inner diameter of the second cover portion by friction;

ii. the spaced relationship for positioning the second portion on the open top of the cylindrical sheath such that the inner cylinder is positioned on the inner part of the sheath and the outer cylinders inner surface is in contact with a surface on the outer diameter of the sheath for holding the second portion in place, the second cover portion is slidably adjustable with respect to the first cover portion.

2. A cover according to claim 1 wherein the alignment device is a series of accordion pleats at the bottom of the cylindrical sheath.

3. A cover according to claim 1 wherein the alignment device is a flaring boot portion acceptor which is positioned on the vent pipe flashing raised boot which allows the flaring boot portion to rotate on the acceptor to make the selected roof pitch alignment.

4. A method of weatherproofing a plumbing vent pipe with a raised boot crown vent flashing, the flashing having a gasket seal for sealing against the vent pipe on an inclined roof having a selected roof pitch, the flashing positioned at least partially under roofing material on the roof comprising:

a) providing a pipe cover comprising i. a first cover portion comprising a. a cylindrical sheath having an open bottom and top, the cylindrical sheath having an inner diameter and an outer diameter, the inner diameter larger than an outer diameter of the vent pipe, the inner diameter of the sheath being uniform from the top to the bottom, the sheath terminating in a flaring boot portion;

ii. the flaring boot portion in fluid connection with the open bottom and extending from the sheath for positioning over and covering the raised boot crown of the vent flashing without being positioned beneath the roofing material, the flaring boot portion defining a cavity extending away from the sheath configured to enclose the flashing; and c. an alignment device adjustably connecting the cylindrical sheath to the flaring boot portion sufficient to align the sheath on the vent pipe and the flaring boot portion on the raised portion based on the selected roof pitch;

ii. a. second cover portion comprising: a. an inner and outer cylinder concentrically positioned in spaced relationship by a connection at the top end of each cylinder, and wherein a surface of the outer diameter of the sheath is held against an inner diameter of a second cover portion of the cover by friction;

b. the spaced relationship for positioning the second portion on the open top of the cylindrical sheath such that the inner cylinder is positioned on the inner part of the sheath and the outer cylinders inner surface is in contact with the surface on the outer diameter of the sheath for holding the second portion in place, the second cover portion is slidably adjustable with respect to the first cover portion;

b) slidingly engaging the first portion over the vent pipe until the flaring boot portion covers at least a portion of the raised boot portion of the vent flashing; and c) slidingly engaging the second portion over the vent pipe and first portion such that the inner cylinder is positioned inside the vent pipe and the outer cylinder is positioned outside the vent pipe and covers the top of the first portion.

5. A plumbing vent pipe cover according to claim 1 wherein the cylindrical sheath has one or more friction rings on the inner diameter for grabbing an outer diameter of the vent pipe by friction.

6. A method according to claim 4 wherein the cylindrical sheath has one or more friction rings on the inner diameter for grabbing an outer diameter of the vent pipe by friction.

7. A plumbing vent pipe cover for placement on a vent pipe installed on an inclined roof having a selected roof pitch, the pipe cover comprising:

a) a first cover portion comprising:

i. a cylindrical sheath having an open bottom and top for receiving the vent pipe therein, the cylindrical sheath having an inner diameter and an outer diameter, the inner diameter of the sheath being uniform from the top to the bottom, the sheath terminating in a flaring boot portion;

ii. the flaring boot portion in fluid connection and extending from the open bottom for positioning over at least a portion of the raised boot portion of the vent flashing without being positioned beneath the roofing material, the flaring boot portion defining a cavity extending away from the sheath configured to enclose the flashing; and iii. an alignment device extending from the flaring boot portion sufficient to align the first pipe cover on the vent pipe, the device rotatably attached to the flaring boot portion and defining a cavity extending away from the flaring boot portion configured to enclose the flashing, such that when the vent pipe cover is placed on the vent pipe the alignment device is rotatable with respect to the vent pipe and the flaring boot portion and the flashing;

b) a second cover portion comprising:

i. an inner and outer cylinder concentrically positioned in spaced relationship by a weatherproof connection at the top end of each cylinder, wherein a surface of the outer diameter of the sheath is held against an inner diameter of the second cover portion by friction;

ii. the spaced relationship for positioning the second portion on the open top of the cylindrical sheath such that the inner cylinder is positioned on the inner part of the sheath and the outer cylinders inner surface is in contact with a surface on the outer diameter of the sheath for holding the second portion in place, the second cover portion is slidably adjustable with respect to the first cover portion.

* * * * *